US010567868B2

(12) United States Patent
Qin

(10) Patent No.: US 10,567,868 B2
(45) Date of Patent: Feb. 18, 2020

(54) SOUND GENERATOR

(71) Applicant: Peng Qin, Shenzhen (CN)

(72) Inventor: Peng Qin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 129 days.

(21) Appl. No.: 15/417,071

(22) Filed: Jan. 26, 2017

(65) Prior Publication Data

US 2018/0213319 A1 Jul. 26, 2018

(51) Int. Cl.
*H04R 1/28* (2006.01)

(52) U.S. Cl.
CPC ..... *H04R 1/2857* (2013.01); *H04R 1/2842* (2013.01); *H04R 2499/11* (2013.01)

(58) Field of Classification Search
CPC combination set(s) only.
See application file for complete search history.

(56) References Cited

U.S. PATENT DOCUMENTS 8,564,076 B1 * 10/2013 Huang ..... B81B 7/0064 257/414
2007/0195984 A1 * 8/2007 Yang ..... H04R 1/1075 381/372
2010/0329496 A1 * 12/2010 Mottonen ..... H04M 1/0245 381/349
2013/0128130 A1 * 5/2013 Yamauchi ..... H04N 5/642 348/836
2013/0223655 A1 * 8/2013 Lee ..... H04R 1/00 381/189
2015/0304747 A1 * 10/2015 Wang ..... H04R 5/02 381/345

* cited by examiner

*Primary Examiner* — Duc Nguyen
*Assistant Examiner* — Assad Mohammed
(74) *Attorney, Agent, or Firm* — IPro, PLLC; Na Xu

(57) ABSTRACT

A sound generator includes a housing with an acoustic cavity and including a mounting base and a separation plate extending from the mounting base to the outside of the housing; a speaker unit accommodated in the acoustic cavity and being mounted on the mounting base; a front cavity and a back cavity formed by acoustic cavity divided by the mounting base, the speaker unit and the separation plate; and at least one cavity extending from the mounting base and/or the separation plate. The cavity has at least a first through-hole for communicating the cavity with the front cavity and at least a second through-hole for communicating the cavity with the back cavity.

8 Claims, 4 Drawing Sheets

SOUND GENERATOR

FIELD OF THE PRESENT DISCLOSURE

The present disclosure relates to the field of electro-acoustic transducers, and more particularly to a sound generator used in a portable electronic device.

DESCRIPTION OF RELATED ART

With the increasingly thin consuming electronics products, such as mobile phones, tablet PCs and other portable electronic equipment, the sound cavity structure of the speaker inside the product is gradually changed from the front sound radiation mode into the side sound radiation mode.

A sound generator of the related technology includes a housing with an accommodation space and a speaker unit located in the accommodation space. The speaker unit includes a diaphragm for vibrating to generate sound. The diaphragm and the housing enclose a front cavity. The housing includes a bottom wall and a plurality of side walls extending from the bottom wall. The sound generator is provided with a sound channel arranged through the side wall for being communicated with the front cavity.

However, due to the resonance of the front cavity, the high-frequency signals and high-frequency noises are amplified. In addition, the sense of hearing would be seriously affected due to the high-frequency sound or high-frequency noise, which is not good for the sound quality adjustment loudspeaker.

Thereof, it is necessary to disclose and provide an improved sound generator to overcome the above-mentioned disadvantages.

BRIEF DESCRIPTION OF THE DRAWING

Many aspects of the exemplary embodiments can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby are only to explain this disclosure, not intended to limit this disclosure.

Figure 2:
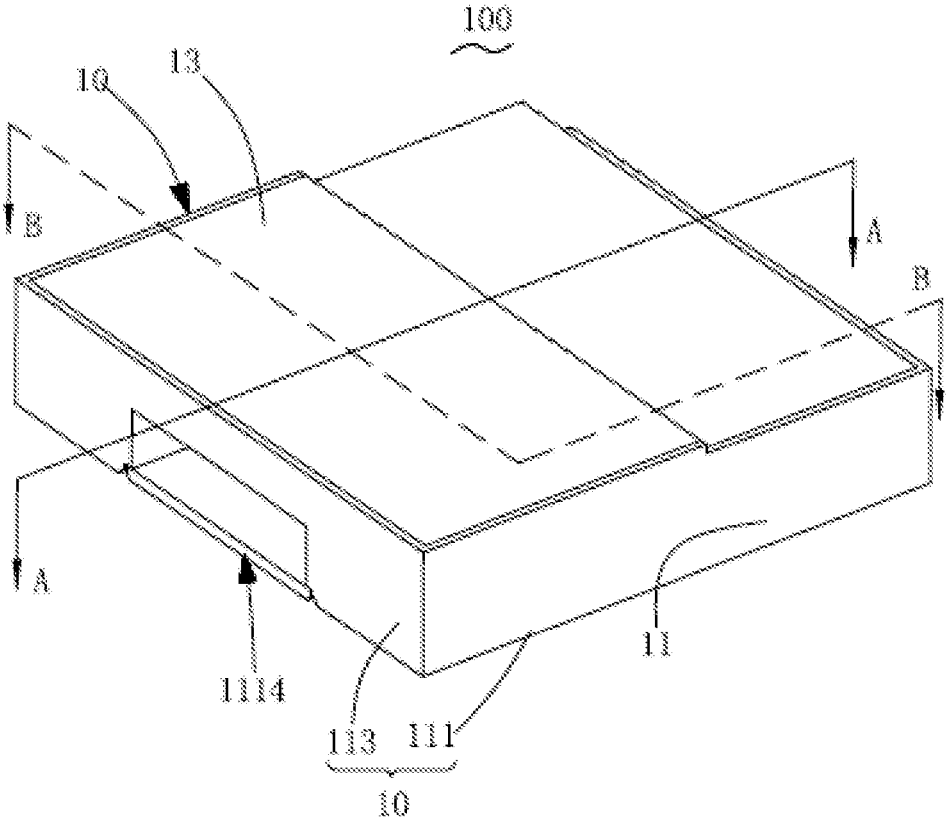
FIG. 2 is a cross-sectional view of a housing of the sound generator taken along line A-A in FIG. 1.
Figure 1:
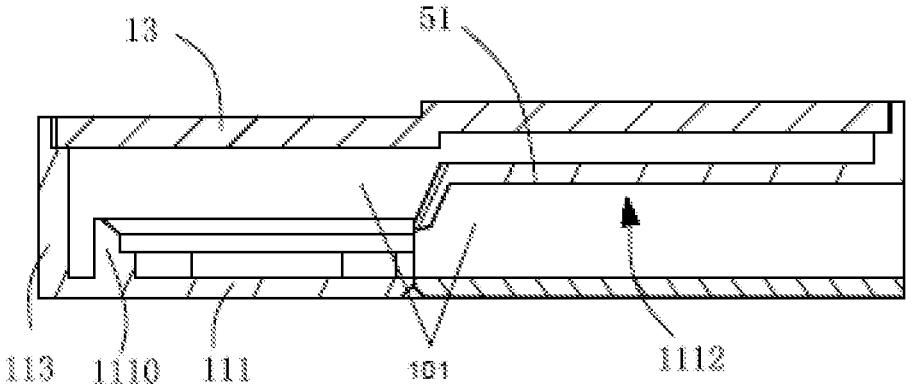
FIG. 1 is an isometric view of a sound generator in accordance with a first exemplary embodiment of the present disclosure.
Figure 3:
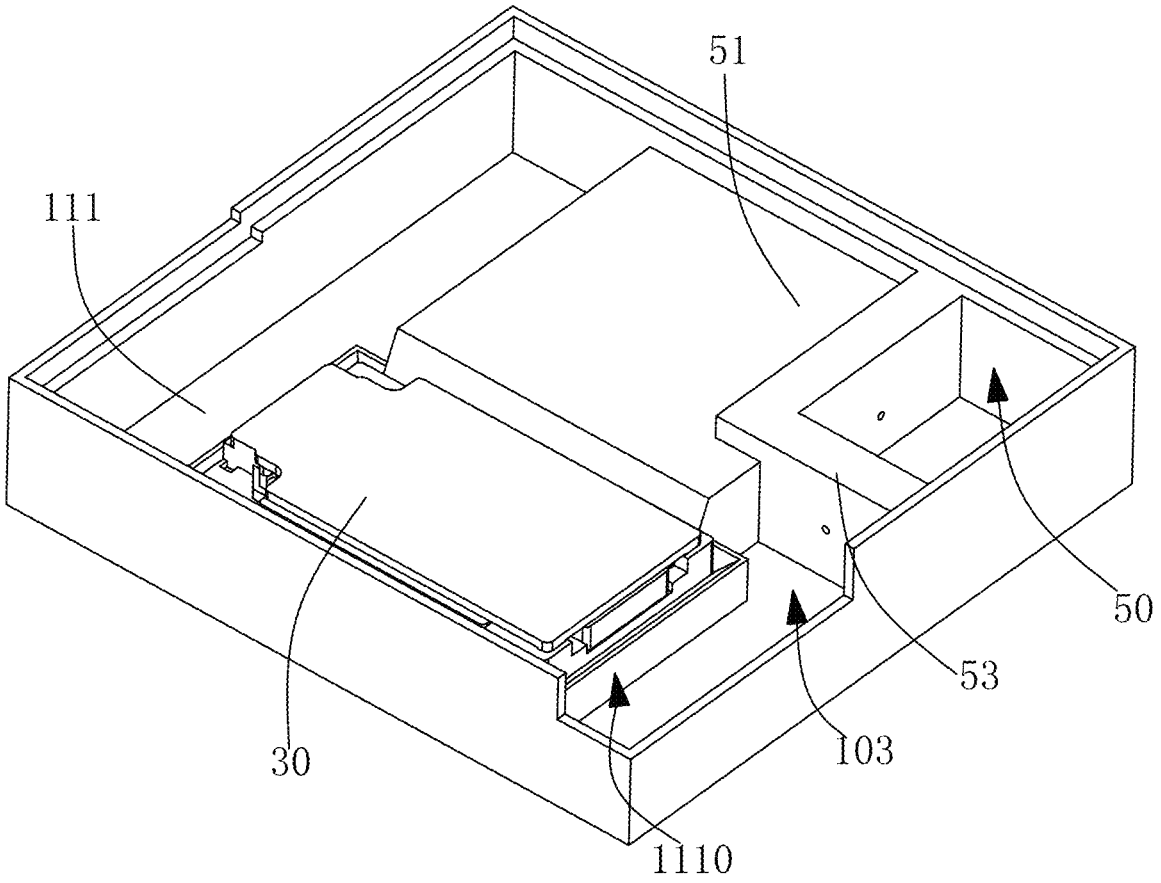
FIG. 3 is an isometric view of the sound generator, similar to FIG. 1, but the housing thereof has been removed.
Figure 4:
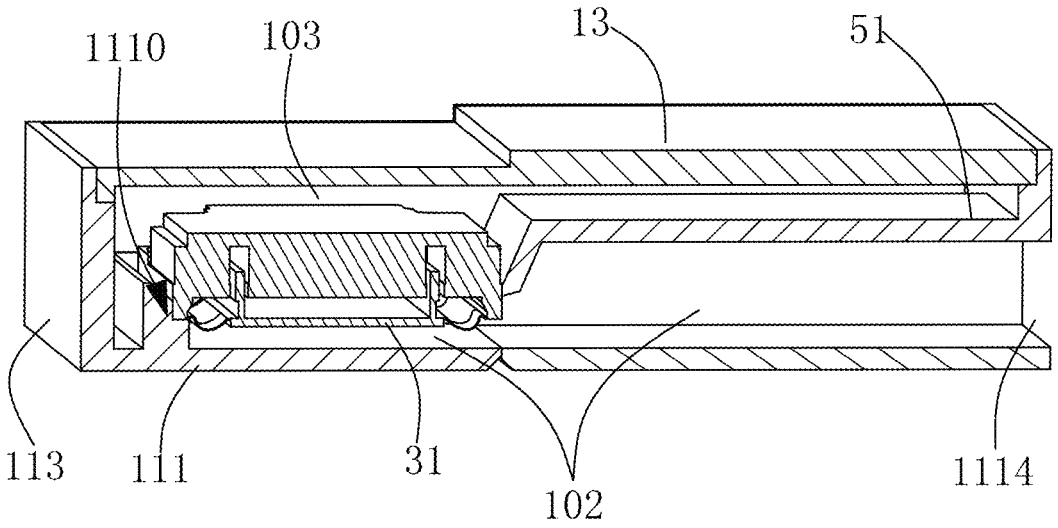
FIG. 4 is a cross-sectional view of the sound generator taken along line A-A in FIG. 1.

Referring to FIGS. 1-3, a sound generator 100, in accordance with a first exemplary embodiment of the present disclosure, comprises a housing 10 with an acoustic cavity 101 and a speaker unit 30 accommodated in the acoustic cavity 101. As shown in FIG. 2, the housing 10 includes a mounting base 1110 for mounting the speaker unit 30 thereon, and a separation plate 51 extending from the mounting base 1110 to the outside of the housing 10. As shown in FIGS. 3-4, the mounting base 1110, the separation plate 51, and the speaker unit 30 divide the acoustic cavity in the housing 10 into a front cavity 102 and a back cavity 103.

The housing 10 includes an upper case 11 with an opening at one end, and a rear cover 13 which covers the opening and encloses the acoustic cavity 101 with the upper case 11. The upper case 11 includes a bottom wall 111 parallel to the rear cover 13 and a side wall 113 extending from an edge of the bottom wall 111 toward the rear cover 13. And a mounting groove 1110 for accommodating and mounting the speaker unit 30 is formed on the bottom wall 111 by extending toward the rear cover 13. A sound channel 1112 toward the side wall 113 is formed between the bottom wall 111 and the separation plate 51, and the sound channel 1112 forms a sound port 1114 in the side wall 113.

The speaker unit 30 is assembled in the mounting groove 1110. The speaker unit 30 includes a diaphragm 31 facing the bottom wall 111, and the diaphragm 31, the mounting groove 1110 and the bottom walls 111 form the front cavity 102. As shown in FIG. 3, the separation plate 51, the mounting groove 1110 and the upper case 11 are integrated formed.

Figure 5:
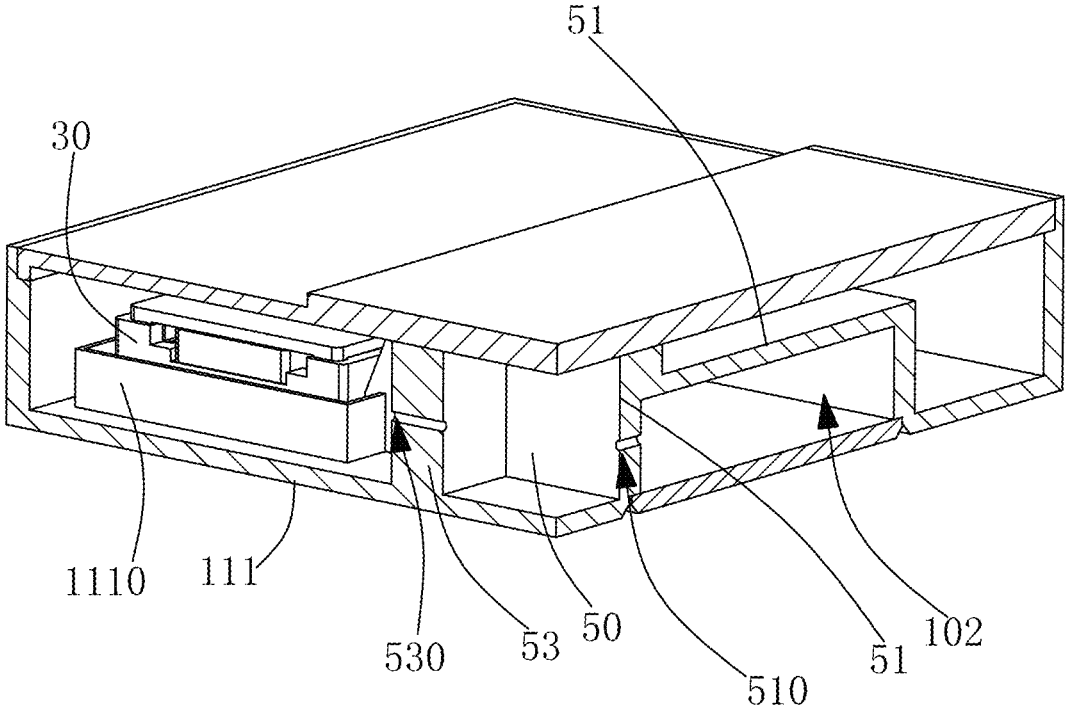
FIG. 5 is a cross-sectional view of the sound generator taken along line B-B in FIG. 1.

Referring to FIG. 3 and FIG. 5, the sound generator 100 further includes a cavity 50 formed between the front cavity 102 and the back cavity 103. In this embodiment, the cavity 50 extends from the separation plate 51, the rear cover 13 for forming a peripheral wall 53, and the cavity 50 is surrounded by the separation plate 51, the bottom wall 111, the peripheral wall 53 and the rear cover 13, that is, the rear cover 13 seals the cavity. A first through hole 510 is formed in the separation plate 51, and the cavity 50 are communicated with the front cavity 102 through the first through hole 510. A second through hole 530 is formed in the peripheral wall 53. The cavity 50 is communicated with the back cavity 103 through the second through hole 530.

Figure 6:
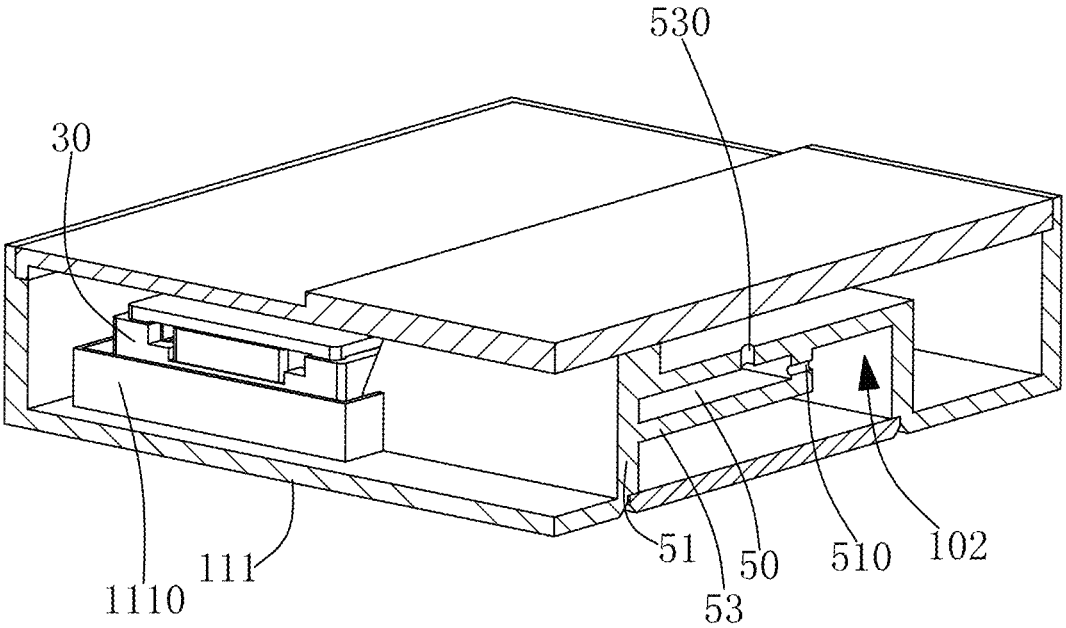
FIG. 6 is a cross-sectional view of a sound generator in accordance with a second exemplary embodiment.

As shown in FIG. 6, alternatively, the separation plate 51 extends for forming the peripheral wall 53 which encloses the cavity 50. Therefore, in the present example, the cavity 50 is surrounded by the separation plate 51 and the peripheral wall 53 extending from the separation plate. As shown in FIG. 6, the cavity 50 may be formed in the sound channel 1112, that is, the first through-hole 510 communicating with the front cavity 102 and the cavity 50 is provided in the peripheral wall 53, and the second through hole 530 is formed in the peripheral wall 53. At the same time, the cavity 50 may be formed in the back cavity 103. In this case, the second through hole communicating with the back cavity 103 and the cavity 50 is formed in the peripheral wall 53.

Figure 7:
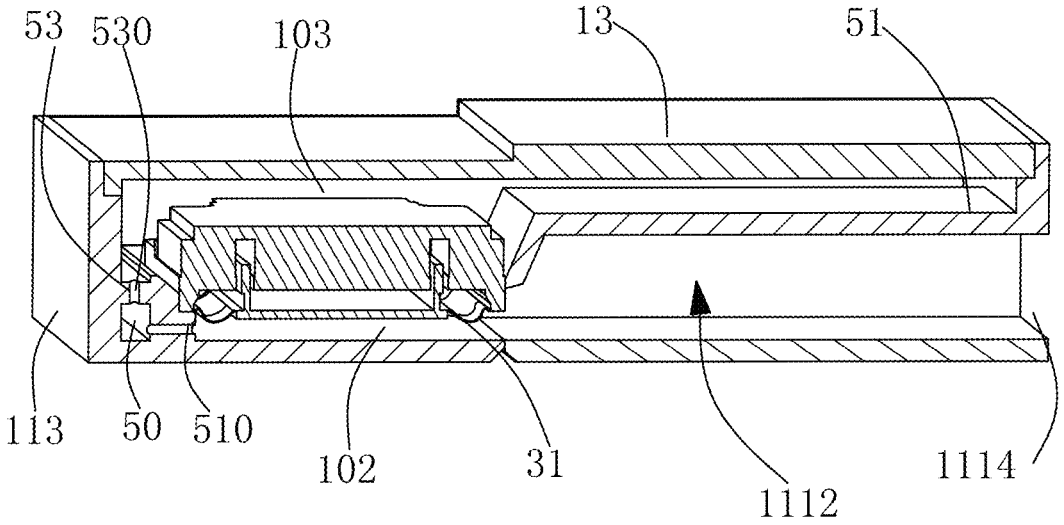
FIG. 7 is a cross-sectional view of a sound generator in accordance with a third exemplary embodiment.

As shown in FIG. 7, alternatively, the cavity 50 extends from the side wall of the mounting groove 1110 into the back cavity 103. Specifically, side surface of the mounting groove 1110 near the back cavity 103 extends and forms the peripheral wall 53 enclosing the cavity 50. As shown in FIG. 7, the cavity 50 may be formed by the groove sidewall, the peripheral wall 53, and the housing abutted and sealed to the peripheral wall, (no side wall 113 is provided in the present embodiment). Similar to the above embodiment, the cavity 50 may be surrounded and sealed by the peripheral wall 53 and the groove side wall. In particular, the peripheral wall of the cavity 50 may extend toward the rear cover 13, the bottom wall 111, and/or the side wall 113. In the present embodiment, the peripheral wall of the cavity 50 is provided with the second through hole 530 communicating with the back cavity 103 and the cavity 50, and the second through hole 510 communicating the cavity 50 and the front cavity 102 is formed in the groove side wall of the mounting groove 1110.

By adjusting the sizes of the first through hole 510 and the second through hole 530, and the volumes of the front cavity 102 and the back cavity 103, when the current cavity 102 resonates with the first through hole 510, the sound waves of the predetermined frequency in the front cavity 102 are absorbed so as to achieve the purpose of absorbing high-frequency noise. When the back cavity 103 and the second through hole 530 form a resonance, the sound waves of the designated frequency in the back cavity 103 can be absorbed, which may achieve the purpose of adjusting the resonance of the back cavity 103. If the first through hole 510 and the second through hole 530 are adjusted to have the same absorption band for the front cavity 102 and the back cavity 103, because the acoustic wave phase radiated from the back cavity 103 of the speaker unit 30 is opposite to that from the front cavity 102, the through-hole 530 introduces a counter-phase acoustic wave to offset thereby improving the absorption effect of the specified frequency band acoustic wave of the front cavity 102. In addition, the first through hole 510 and the second through hole 530 can also equalize the air pressure. Therefore, the sound generator 100 of the present disclosure has better sense of hearing.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A sound generator including:

a housing with an acoustic cavity, the housing comprising an upper case with an opening at one end, and a rear cover which covers the opening and encloses the acoustic cavity with the upper case, the upper case comprising a bottom wall and a side wall extending from an edge of the bottom wall toward the rear cover, and a mounting base extending from the bottom wall towards into the acoustic cavity and a separation plate extending from the mounting base to the outside of the housing, with a sound channel facing toward the side wall is formed between the bottom wall and the separation plate, and the sound channel forming a sound port in the side wall;

a speaker unit accommodated in the acoustic cavity and being mounted on the mounting base, the separation plate abutting against a side of the speaker unit;

a front cavity and a back cavity formed by acoustic cavity divided by the mounting base, the speaker unit and the separation plate;

at least one peripheral wall extending from the mounting base and/or the separation plate, to obtain a cavity enclosed by the peripheral wall along with the mounting base and/or the separation plate; wherein a first through-hole is formed on one of any two of the peripheral wall, the mounting base and the separation plate, and a second through-hole is formed on the other of the any two of the peripheral wall, the mounting base and the separation plate; and the cavity is a sealed resonant cavity, which communicates with the front cavity only through the first through-hole and communicates with the back cavity only through the second through-hole.

2. The sound generator as described in claim 1, wherein the speaker unit includes a diaphragm facing to the bottom wall, and the front cavity is formed between the diaphragm, the mounting groove and the bottom wall.

3. The sound generator as described in claim 2, wherein the peripheral wall extends from the side wall of the mounting groove to the rear cavity, and the first through hole is formed on the side wall of the mounting groove.

4. The sound generator as described in claim 2, wherein the peripheral wall extends from the separation plate to the back cavity or the sound channel and forms the sound channel with the bottom wall, the cavity is bounded by the peripheral wall extending from the separation plate to the back cavity, the first through hole is provided in the separation plate, and the second through hole is provided in the peripheral wall.

5. The sound generator as described in claim 4, wherein the cavity is enclosed by the peripheral wall and the separation plate.

6. The sound generator as described in claim 4, wherein one end of the peripheral wall away from the separation plate is attached to the back cover for enclosing the cavity.

7. The sound generator as described in claim 4, wherein one end of the peripheral wall away from the separation plate extends to the bottom wall via the sound channel, and the separation plate, the peripheral wall and the bottom wall enclose the cavity.

8. The sound generator as described in claim 4, wherein one end of the peripheral wall away from the separation plate extends to the sound channel, the cavity is enclosed by the separation plate and the peripheral wall.

* * * * *